United States Patent [19]

Schafer

[11] 4,329,667

[45] May 11, 1982

[54] COAXIAL CABLE LOW FREQUENCY BAND-PASS FILTER

[75] Inventor: Robert H. Schafer, Perkasie, Pa.

[73] Assignee: UTI Corporation, Collegeville, Pa.

[21] Appl. No.: 222,227

[22] Filed: Jan. 5, 1981

Related U.S. Application Data

[63] Continuation-in-part of Ser. No. 92,167, Nov. 7, 1979, Pat. No. 4,266,207.

[51] Int. Cl.[3] ..... H01P 1/202; H01P 3/06; H01P 11/00

[52] U.S. Cl. ..... 333/206; 29/600; 333/243; 333/245

[58] Field of Search ..... 333/202, 206, 207, 222, 333/223, 236, 243, 245; 29/600, 601

[56] References Cited

U.S. PATENT DOCUMENTS

| | | | |
|---|---|---|---|
| 2,438,913 | 4/1948 | Hansen | 333/206 |
| 2,521,843 | 9/1950 | Foster, Jr. | 333/206 |
| 2,911,333 | 11/1959 | Capen et al. | 29/600 |
| 4,161,704 | 7/1979 | Schafer | 333/206 X |

*Primary Examiner*—Marvin L. Nussbaum

*Attorney, Agent, or Firm*—Seidel, Gonda, Goldhammer & Panitch

[57] ABSTRACT

The band-pass filter portion of a coaxial cable includes filter elements in the form of a laminate of dielectric material having a conductive layer on opposite faces. Attached to each conductive layer is a mass which is the electrical equivalent of a shunt capacitor. Each such mass is joined to a center conductor. A sleeve of dielectric material surrounds each center conductor except in the area of the filter. A seamless tube of dielectric material surrounds the filter elements and the dielectric sleeves. A monolithic jacket of electrically conductive metal surrounds said seamless tube.

7 Claims, 7 Drawing Figures

COAXIAL CABLE LOW FREQUENCY BAND-PASS FILTER

RELATED CASE

This application is a CIP of Ser. No. 92167 filed Nov. 7, 1979 by Robert H. Schafer and entitled Coaxial Cable Band-Pass Filter and now U.S. Pat. No. 4,266,207.

BACKGROUND

The present invention is an improvement over the co-axial cables disclosed in U.S. Pat. No. 4,161,704 and the above-identified application. The present invention is directed to a solution of the problem of how to lower the frequency range of the band pass filter so as to be below 8 GHz with substantially complete high frequency rejection while at the same time being miniature in size. Filters in accordance with the above-mentioned pending application have a disadvantage in that at low frequency, the units are impractically long whereby they are unacceptable in miniature advanced technology packaging.

SUMMARY OF THE INVENTION

The present invention is directed to a coaxial cable having at least one band-pass filter coupling element in the form of a laminate of dielectric material having a conductive layer on opposite faces. Attached to each such conductive layer is a mass which is the electrical equivalent of a shunt capacitor and performs as a lumped circuit element. There is provided at least two center conductors. Each center conductor has one end metallurgically joined to a separate one of said masses. A sleeve of dielectric material surrounds each center conductor except in the area between the ends of the filter.

A seamless tube of dielectric material surrounds and contacts the outer periphery of said sleeve and laminent. A monolithic jacket of electrically conductive material surrounds said seamless tube and exerts radially inward compressive force on the entire circumference of said seamless tube to eliminate any air gap therebetween.

It is an object of the present invention to improve the construction and method of assembly of low frequency band-pass filters for use in coaxial cables.

It is an object of the present invention to provide low frequency band-pass filters with a very small compact design at up to about 8 GHz with substantially complete high frequency rejection.

It is another object of the present invention to provide a specified low frequency band-pass filter performance in a miniature package at frequencies which one half wave resonator techniques become unacceptable due to their extreme length.

Other objects and advantages will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
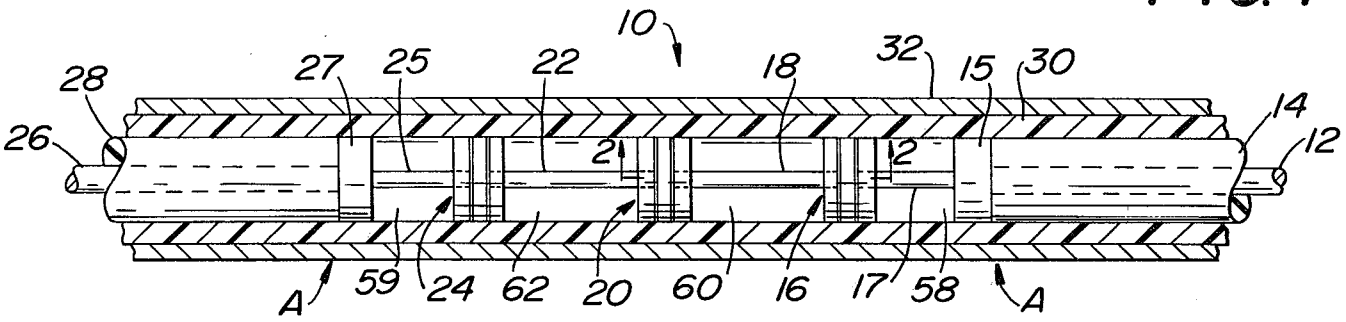
FIG. 1 is a longitudinal sectional view of a coaxial cable in accordance with the present invention.

Referring to the drawing in detail, wherein like numerals indicate like elements, there is shown in FIG. 1 a coaxial cable having a four stage band-pass filter in accordance with the present invention designated generally as 10. The device 10 includes a plurality of center conductors. Center conductor 12 is surrounded by a dielectric sleeve 14 and has one end metallurgically bonded to a major face of shunt end coupling capacitor 5. The other face of capacitor 15 is similarly bonded to one end of a resonant conductor 17. The other end of conductor 17 is similarly bonded to a filter coupling element 16. The opposite face of element 16 is metallurgically bonded to one end of a resonant conductor 18.

The other end of conductor 18 is metallurgically bonded to one face of a filter coupling element 20. The opposite face of element 20 is metallurgically bonded to one end of a resonant conductor 22. The other end of conductor 22 is metallurgically bonded to one face of a filter coupling element 24. The opposite face of element 24 is similarly bonded to one end of a resonant center conductor 25. The other end of conductor 25 is similarly bonded to a major face of shunt end coupling capacitor 27. The other major face of capacitor 27 is similarly bonded to one end of center conductor 26. The diameter of conductors 12 and 26 is greater than the diameter of conductors 17, 18, 22 and 25. Conductor 26 is surrounded by dielectric sleeve 28.

The center conductors 12 and 26 are coaxial with the resonant conductors 17, 18, 22 and 25 and preferably are made from a silver plated copper alloy having higher tensile strength than copper such as a product sold under the trademark TENSILFLEX. The resonant conductors 17, 18, 22 and 25 are preferably made from a similar material such as a silver plated copper alloy sold under the trademark COPPERWELD. The sleeves 14 and 28 are made from identical dielectric material such as a material sold commercially under the trademark TEFLON.

A seamless tube 30 of dielectric material surrounds each of the sleeves 14 and 28, capacitors 15 and 27, as well as the filter coupling elements 16, 20 and 24. Tube 30 is preferably made from the same dielectric material as the sleeves 14, 28. A jacket 32 surrounds the tube 30. Jacket 32 is preferably a monolithic jacket of electrically conductive material such as copper having a thickness of about 0.010 inches. Where greater strength is needed, the jacket 32 may be made of stainless steel with a layer of copper on its inner periphery. The jacket 32 is preferably applied in a manner disclosed in U.S. Pat. No. 4,161,704 so that the jacket exerts a radially inward compressive force on the entire circumference of the seamless tube 30 to eliminate any air gap therebetween. An air gap does exist between tube 30 and the conductors 17, 18, 22 and 25.

Figure 2:
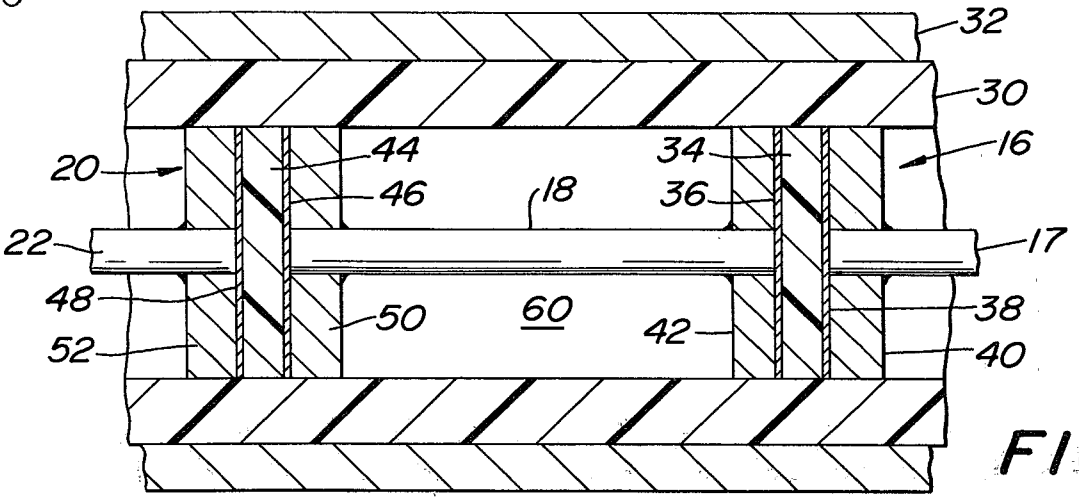
FIG. 2 is a sectional view taken along the line 2—2 in FIG. 1 but on an enlarged scale.

Capacitors 15 and 27 are identical copper discs which couple the filter elements to the center conductors 12 and 26. The filter coupling elements 16 and 24 are identical with one being the mirror image of the other. Hence, only elements 16 and 20 will be described in detail. Referring to FIG. 2, the filter coupling element 16 comprises a laminate with a central dielectric layer 34 clad on one surface with a thin conductive layer 36 and clad on its opposite surface with a thin conductive layer 38. Layers 34, 36, and 38 define a series capacitor.

Layers 36 and 38 are preferably copper having a thickness of 0.001 to 0.002 inches thick. A mass 40 is metallurgically bonded to the layer 38 and conductor 17. Mass 40 is preferably provided with a central hole into which one end of the conductor 17 extends. A mass 42 is metallurgically bonded to the layer 36 and conductor 18. Mass 42 is preferably provided with a central hole into which one end of the conductor 18 extends.

The filter coupling element 20 is identical with the filter coupling element 16 except for thicknesses. The element 20 includes a central dielectric layer 44 clad on one surface with a conductive layer 46 and clad on its opposite surface with a conductive layer 48. Layer 46 is metallurgically bonded to a mass 50. Layer 48 is metallurgically bonded to a mass 52. Mass 50 is preferably provided with a central hole metallurgically bonded to the other end of conductor 18. Mass 52 is preferably provided with a central hole metallurgically bonded to one end of the conductor 22. Each of the masses 40, 42, 50 and 52 is preferably copper.

Each of the masses 40, 42, 50, 52 has a center hole for receiving one of the center conductors for ease of production. That is, it is easier to assemble and concentrically join the masses to their center conductor in this manner. Concentricity is uniformly attained by cutting a copper tube into short lengths to thereby form the masses. The copper tube from which the masses are cut has an inner diameter slightly greater than the diameter of the center conductors. The masses could also have a blind hole or may be solid with no center hole if desired.

The following chart sets forth two specific examples of the present invention wherein the outer diameter of jacket 32 is 0.141±0.002 inches. In the examples, the lengths and thicknesses are indicated in inches.

| | Example #1 | Example #2 |
|---|---|---|
| frequency band | 5.8 to 6.4GHz | 5.73 to 6.08GHZ |
| gap 58, 59 length | .1245 | .1066 |
| mass 40 thickness | .0344 | .0425 |
| layer 34 thickness | .031 | .020 |
| mass 42 thickness | .0249 | .1155 |
| gap 60 length | .1962 | .079 |
| mass 50 thickness | .0334 | .1085 |
| layer 44 thickness | .031 | .015 |
| mass 52 thickness | .0334 | .1085 |
| gap 62 length | .1962 | .079 |
| conductor (12, 26) diameter | .036 | .036 |
| resonator 17, 18, 22, 25 diameters | .014 | .014 |
| diameter of mass 40, 42, 50, 52 | .092 | .092 |
| diameter jacket 32 | .141 | .141 |
| length A-A | 1.16 | 1.29 |

Figure 3:
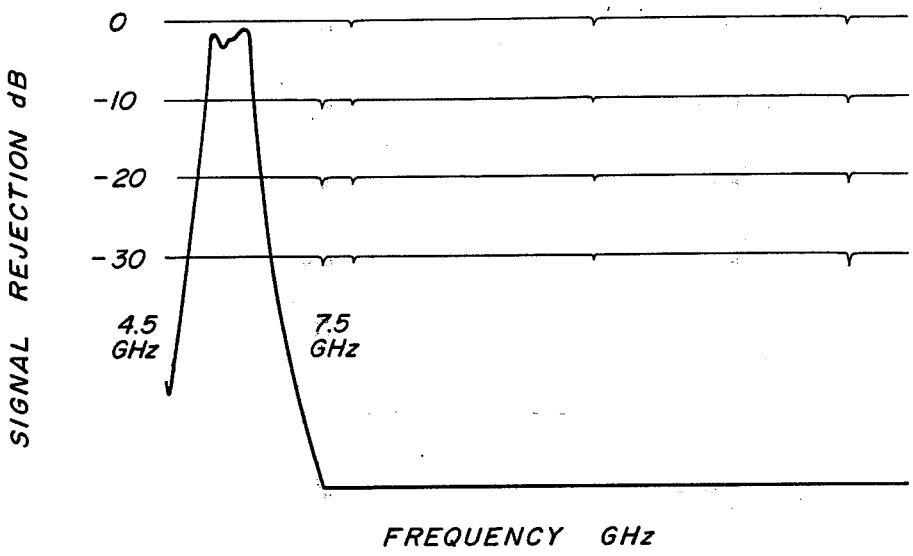
FIGS. 3–6 are diagramatic graphs showing high frequency rejection at various band widths.
Figure 4:
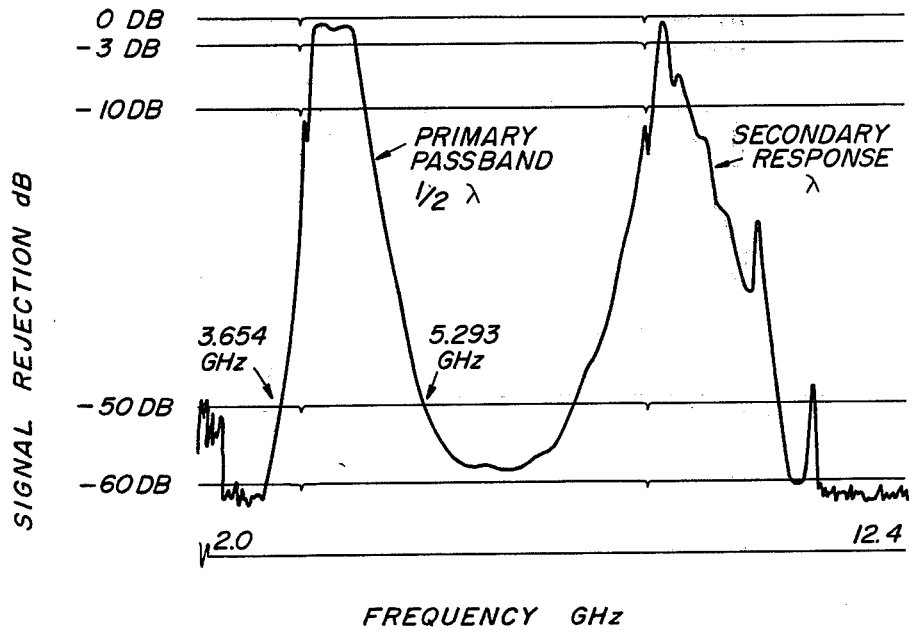

FIG. 3 is a graph of the signal rejection in decibels plotted against signal frequency in GHz for example #2 in the above chart. It will be noted that there is almost complete transmission in the primary pass-band with no secondary pass-band. FIG. 4 is a similar graph showing a primary pass-band at one half wave length and a secondary response at a full wave length. The graph of FIG. 4 illustrates the response obtained from the apparatus disclosed in the above-mentioned patent. Where a secondary response is objectionable, the present invention solves that problem.

Figure 5:
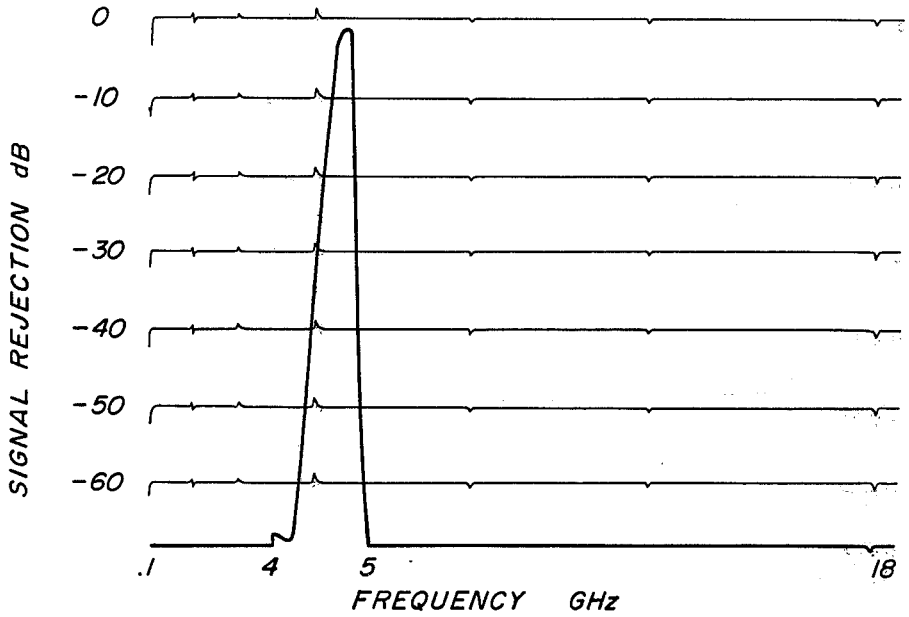

FIG. 5 is a similar graph showing a primary passband with no secondary response. The filter illustrated by way of FIG. 5 is a graph of a third embodiment designed with a primary passband of 4.1 to 4.5 GHz and otherwise constructed in accordance with the teachings set forth above in examples 1 and 2.

Figure 6:
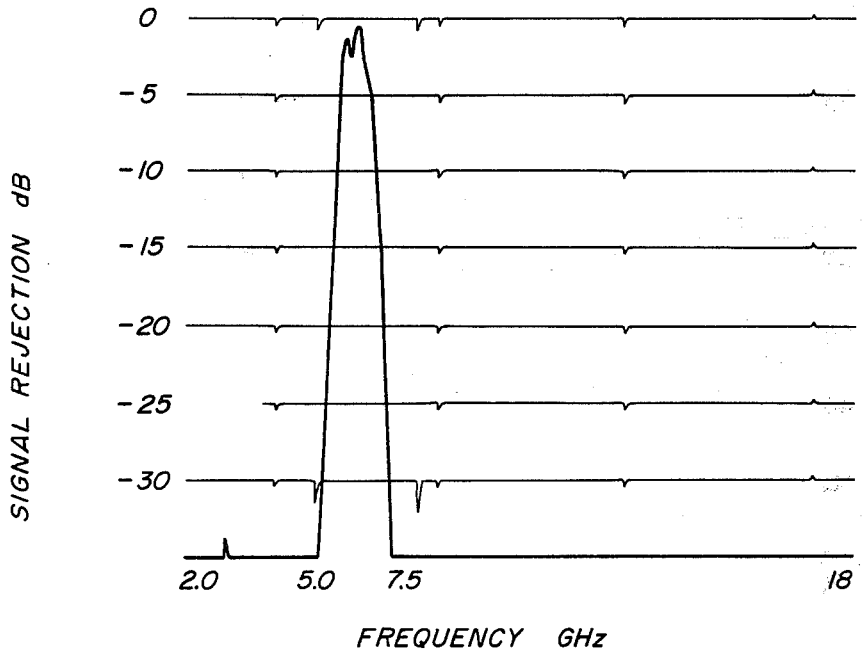

FIG. 6 is a similar graph showing the primary passband with no secondary response and illustrates example #1 described above. It will be noted that in each of FIGS. 5 and 6 the rejection is substantially complete.

Figure 7:
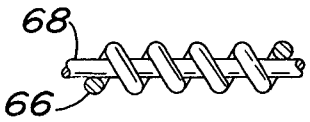
FIG. 7 is a plan view of a portion of a modified conductor.

As will be apparent from the chart set forth above, the straight length of cable necessary for accommodating the filter coupling elements is less than 1.5 inches. That length may be further reduced by using coiled conductors in place of conductors 18 and 22. A typical coil conductor involves silver coated annealed copper (as per ASTM B-298) wire 66 having a diameter of 0.0045 inches wrapped around a core of fiberglass 68 or equivalent material having a diameter of 0.0265 inches. See FIG. 7. The preferred minimum distance between two adjacent turns of the wire is 0.0174 to 0.0188 inches. Coiled wire 66 provides a substantial amount of inductance over a short length whereby the frequency can be reduced to about 300 MHz.

Thus, the filters made in accordance with the present invention are compact or miniaturized for low frequency use due to the lumped element circuit. Each of the masses 40, 42, 50, 52, etc. constitutes a circuit component whose dominant equivalent circuit is a shunt capacitor for high frequency rejection without any secondary response. Each of the elements 16, 20, 24 is a series capacitor with a shunt capacitor mechanically attached to opposite sides thereof.

The present invention may be embodied in other specific forms without departing from the spirit or essential attributes thereof and, accordingly, reference should be made to the appended claims, rather than to the foregoing specification, as indicating the scope of the invention.

I claim:

1. A coaxial cable comprising at least two center conductors aligned with one another, at least one low frequency band-pass filter coupling element between said center conductors, said element being a laminate of dielectric material having a conductive layer on opposite faces, each layer being bonded to a mass whose dominant equivalent circuit is a shunt capacitor, each conductor having one end metallurgically joined to a separate one of said masses, a sleeve of dielectric material surrounding and contacting the outer periphery of said laminent, and a monolithic jacket of electrically conductive material surrounding said tube and exerting radially inward compressive forces on the entire circumference of said tube to eliminate any air gap therebetween.

2. Apparatus in accordance with claim 1 wherein said masses are metallurgically bonded to a conductive layer clad on opposite faces of said dielectric material.

3. Apparatus in accordance with claim 1 wherein said masses are each a right circular cylinder whose outer diameter is less than 0.125 inches.

4. Apparatus in accordance with claim 1 including a plurality of said coupling elements interconnected with a center conductor therebetween for passing a frequency band below 8 GHz with substantially complete rejection of frequencies above the passband.

5. Apparatus in accordance with claim 1 wherein each mass has a center hole into which its associated center conductor extends.

6. Apparatus in accordance with claim 1 wherein at least one of said conductors is coiled.

7. A coaxial cable having at least three low frequency band-pass filter coupling elements each in the form of a laminate of dielectric material having opposite conductive faces metallurgically bonded to a mass whose dominant equivalent circuit is a shunt capacitor having substantially complete high frequency rejection, said elements being in series with the second element being the middle element, said second element having masses of equal thickness, said first and third elements having masses of dissimilar thicknesses, the thinner mass of each of the first and third elements being closer to said second element than the thicker mass associated therewith, each element being coupled to an adjacent element by a resonant conductor, center conductors surrounded by a dielectric sleeve and having one end metallurgically bonded to a face of shunt capacitors, the opposite face of said shunt capacitors being connected by a resonant conductor to one of the first and third elements, a seamless tube of dielectric material surrounding each element and each sleeve, a monolithic jacket of electrically conductive material surrounding said tube and exerting radially inward compressive forces on the entire circumference of said tube to eliminate any air gap therebetween, each resonant conductor being spaced from the inner periphery of said seamless tube by an air gap.

* * * * *